United States Patent [19]

Wagner et al.

[11] Patent Number: 5,072,478

[45] Date of Patent: Dec. 17, 1991

[54] VERTICAL BLIND CLEANING MACHINE

[76] Inventors: Richard N. Wagner, 7105 Greengate Ct., Louisville, Ky. 40241; George W. Ebert, 3017 Woodpine Cir., Sarasota, Fla. 34231

[21] Appl. No.: 477,278

[22] Filed: Feb. 8, 1990

[51] Int. Cl.[5] ..... A47L 1/02; A47L 11/02

[52] U.S. Cl. ..... 15/102; 15/77; 15/308

[58] Field of Search ..... 15/77, 102, 302, 308, 15/309.1, 309.2; 134/122 R

[56] References Cited

U.S. PATENT DOCUMENTS

| | | | |
|---|---|---|---|
| 2,282,628 | 5/1942 | Whann et al. | 15/102 X |
| 2,682,676 | 7/1954 | Franchi | 15/77 |
| 2,708,281 | 5/1955 | Gaydos | 15/102 |
| 2,818,595 | 1/1958 | Rosewall | 15/309.1 |
| 3,333,291 | 8/1967 | Hondzinski | 15/302 |
| 3,396,422 | 8/1968 | Haverberg | 15/308 |
| 3,615,821 | 10/1971 | Miller | 15/309.1 X |
| 3,849,831 | 11/1974 | DeVerter et al. | 15/302 |
| 3,877,107 | 4/1975 | Cirino | 15/302 |
| 3,938,213 | 2/1976 | DiFede | 15/77 |
| 3,938,214 | 2/1976 | Hodsden et al. | 15/102 |
| 4,119,991 | 10/1978 | Martino | 15/102 X |
| 4,129,919 | 12/1978 | Fitch et al. | 15/302 |
| 4,148,576 | 4/1979 | Martino | 15/77 X |
| 4,261,760 | 4/1981 | Kandel | 15/309.1 X |
| 4,561,144 | 12/1985 | Marais | 15/302 |
| 4,569,,695 | 2/1986 | Yamashita et al. | 15/77 X |
| 4,605,027 | 8/1986 | Dallot | 134/122 R X |
| 4,798,008 | 1/1989 | Belanger et al. | 15/302 X |
| 4,817,646 | 4/1989 | Brooks | 134/26 |
| 4,918,778 | 4/1990 | Chupin et al. | 15/102 X |
| 4,926,520 | 5/1990 | Watson | 15/302 |

FOREIGN PATENT DOCUMENTS

| | | | |
|---|---|---|---|
| 8601918 | 2/1987 | Netherlands | 15/103.5 |

*Primary Examiner*—David T. Fidei
*Assistant Examiner*—Beth Anne Cicconi
*Attorney, Agent, or Firm*—Gifford, Groh, Sprinkle, Patmore & Anderson

[57] ABSTRACT

A mobile vertical blind cleaning machine for cleaning both surfaces of individual blind panels of all types including plastic blinds, fabric covered blinds and fabric blinds. An elongated tank is divided into separate liquid tight solution cleaning, rinse and drying chambers with a pair of feed rolls located at the entrance end of each of the chambers and the exit end of the drying chamber. The single tank has an overall length and weight to be moved by a single person for on site cleaning. A rinse water hose connection, shop vacuum suction/air connection and a 115 VAC electrical connection are the only external requirements for operation.

15 Claims, 1 Drawing Sheet

VERTICAL BLIND CLEANING MACHINE

BACKGROUND OF THE INVENTION

1. Field of the Invention

This invention relates to a blind cleaning machine, and, more particularly, it relates to a portable vertical blind cleaning machine.

2. Description of the Prior Art

Venetian blinds which have horizontal slats and vertical blinds are commonly cleaned in the home business location and at commercial cleaning establishments by the use of hand held brushes and sponge devices which result in a time consuming process and a commercially expensive operation. With Venetian blinds having been in use for a long time, a variety of commercial cleaning equipment has been developed. One such device is shown in U.S. Pat. No. 4,817,646 which involves the use of separate stationary cleaning and rinsing tanks in which the blind in its drawn together condition is sequentially immersed and then move to a separate blow dry station. This type of equipment is said to be successful for the recently popular mini blind as long as they are frequently cleaned so that a brushing operation not necessary to remove heavier grime, grease and dirt. This type of equipment must have a stationary mounting at a given location or at best be permanently mounted in a mobile truck structure.

Another type of wet cleaning apparatus involves passing the blind through the equipment in a fully extended position over a tank containing cleaning solution in which a lower power driven brush is immersed in the solution to contact the lower surfaces of the blind slats and an upper driven brush which receives cleaning solution sprayed onto the brush for cleaning the upper slat surfaces.

An early attempt at providing more mobile equipment shown in U.S. Pat. No. 2,682,676 which provides a horizontally extendable pan which is placed on the window sill below the blind into which upright supports are attached for movement of spray pipes and brushes up and down a length of an extended venetian blind. Provision is made for draining the pan and for supplying rinse water to the sprays in a second operation and for providing a compressed air connection or a super heated steam connection in a third drying step. The auxilary facilities necessary and the time consumed in a sequential operation performed in a one pan and support structure device would appear to relegate this type of device to a very limited market.

The more popular equipment for blind cleaning has been in the field of ultrasonic solution cleaning. Because this type of equipment is very expensive and costly to maintain, its use has been limited to commercial cleaning establishments. Some of this ultrasonic equipment requires tanks of sufficient size to receive the blind extended position, while others attempt to minimize equipment size by accepting the blind in its fully drawn together condition. In either case, problems exist in dislodging grease and grime without mechanical brushing contact. Most of this equipment is limited to a given blind width and length.

None of the above mentioned prior art devices are particularly adapted to cleaning of vertical blind panels which can be easily detached from the transport portion of the blind. None of the foregoing art suggests equipment that can be made mobile/portable by an individual to the blind site.

SUMMARY OF THE INVENTION

The foregoing disadvantages of the prior art devices and the advantages of the invention are realized in a vertical blind cleaning machine which cleans both surfaces of individual blind panels whether they be plain plastic blinds or composite cloth fabric blinds attached to a plastic backing or a plain fabric blind panel.

The invention uses a single elongated tank which is divided into separate liquid tight chambers by baffle members to provide a solution cleaning chamber, a rinse chamber and a drying chamber. A pair of vertically aligned contacting feed rolls are located at the entrance end of each of the chambers and at the exit end of the drying chamber for successively and sequentially advancing the blind panels through the solution cleaning chamber, the rinse chamber and the drying chamber. A deflector is used in the cleaning chamber to direct the panel to be completely immersed in the cleaning solution contained in that chamber. A pair of brushes, preferably of the stationary but adjustable type, are located adjacent to the exit end of the cleaning chamber in a position to contact the top and bottom surfaces of the blind panels. Preferably the guide member is curved and extends from adjacent the feed rolls at the entrance end of the cleaning chamber to adjacent the entry point of the blind panels between the brushes. Preferably the pair of feed rolls adjacent the entrance to the rinse chamber are contained within the cleaning chamber between the brushes and the end of the cleaning chamber. The rinse chamber contains spray pipes which direct the rinse medium against both surfaces of the panel. A simple quick disconnect connection to the spray members is provided for a mobile hose connection to an available water tap or to a gravity feed tank should a tap not be available.

The pair of feed rolls at the entrance end of the drying chamber can be within and adjacent the exit end of the rinse chamber or be baffled therefrom. Water is removed from both surfaces of the blind panel in the drying chamber by the movement of air alone or in combination with a squeegee blade in contact with the lower surface of the blind panel. Preferably a vacuum nozzle is used for drawing liquid away from the top surface of the blind panel, and a spring loaded, self adjusting mechanism keeps the nozzle adjacent to that surface. Preferably, liquid is removed from the lower blind panel surface by a blower nozzle although it can be used in combination with a squeegee blade or the squeegee can be used alone. External connection to the vacuum nozzle and blower nozzle can be made to a standard shop vacuum.

The bottom roll of each pair of feed rolls is spring loaded toward the upper roll for driving contact. A good combination which will efficiently convey and act as a seal between chambers includes the use of a hard rubber or synthetic coated lower roll and a softer rubber or synthetic coated upper roll. A common drive is used for rotation of the upper rolls of each pair as by the use of a sprocket and chain drive connected to a drive motor. The motor is preferably of the variable speed type in order to be able to vary the speed of travel of the blind panels through the cleaning machine. A tensioning roll is preferably located between the pair of feed rolls at the entrance to the rinse chamber and the entrance to the drying chamber. A plurality of guide wires extend along the rinse and drying chambers and are arranged in a horizontal plane across the chambers to provide a wire grill which supports the blind panel as it passes through the drying chamber in the same manner as the panel is guided and supported by the deflector in the cleaning chamber. A drain is located at the bottom of each of the chambers to remove the spent cleaning solution, rinse water and water removed in the drying chamber.

When the blind panels being cleaned are cloth only, a leader made of a sufficiently stiff but pliable material such as a PVC plastic and of a length to span the distance between the feed rolls is used. The leader is attached to the forward end of the blind panel by some convenient means such as a spring loaded clip.

BRIEF DESCRIPTION OF THE DRAWING

The preferred embodiments of the invention are illustrated in the drawing in which.

DETAILED DESCRIPTION OF THE PRESENTLY PREFERRED EMBODIMENT OF THE INVENTION

Figures 1, 2, 3, 4, 5, 6, 7:
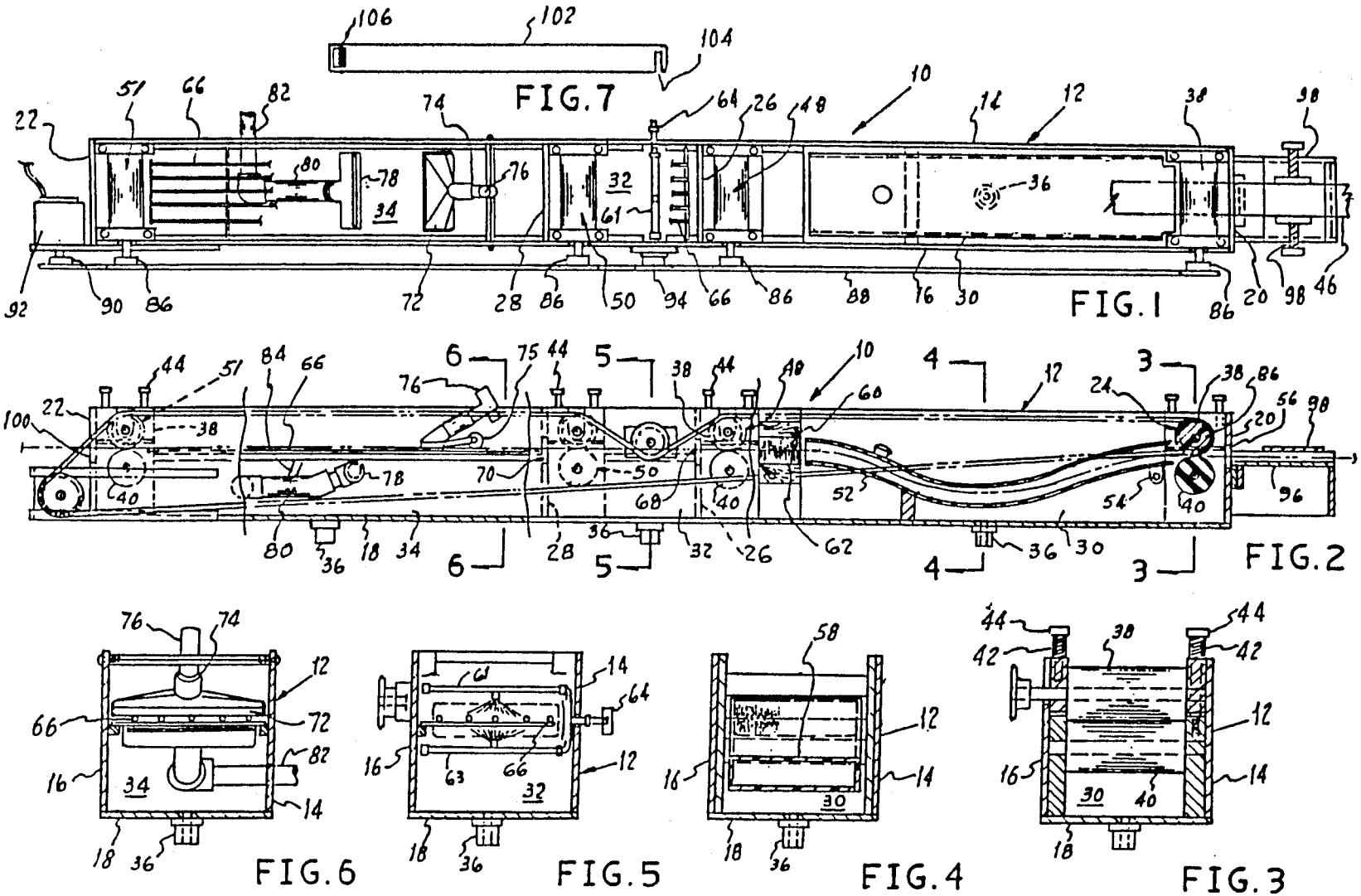
FIG. 1 is a plan view of the blind cleaning machine according to the invention showing the single elongated tank divided into a separate liquid tight solution cleaning chamber, rinse chamber and drying chamber.
FIG. 2 is a elevational view with portions broken away to show the pairs of feed rolls and the implementation in each of the three chambers.
FIG. 3 is a cross sectional view taken along line 3—3 in FIG. 2 at the pair of feed rolls at the inlet end to the solution cleaning chamber.
FIG. 4 is a cross sectional view taken along line 4—4 Of FIG. 2 showing the curved deflector passage at its low point in the cleaning chamber and the drain to that chamber.
FIG. 5 is a cross sectional view taken along line 5—5 in FIG. 2 showing the rinse spray nozzles.
FIG. 6 is a cross sectional view along line 6—6 in FIG. 2 showing the vacuum drying nozzle operating against the top surface of the blind panel and an air nozzle operating against the lower surface of the blind panel.
FIG. 7 is a plan view of a leader used in conjunction with conveying textile or cloth blind panels through the cleaning machine.

Referring to the drawing, the vertical blind cleaning machine 10 according to the invention includes a longitudinally extending tank 12 which can be formed by bending, welding, brazing or otherwise connecting metal side walls 14 and 16 bottom wall 18 entrance and exit walls 20 and 22 respectively with intermediate divider of baffle walls 26 and 28 dividing the tank into a consecutive or contiguous solution cleaning chamber 30, rinse chamber 32, and drying chamber 34. Each of the chambers has a drain 36 which can conveniently be of the plug or petcock type.

A pair 24 of vertically aligned top and bottom feed rolls 38 and 40 are located at the inlet end of the liquid cleaning chamber 30 disposed within the chamber adjacent entrance end wall 20. The bottom roll 40 is biased toward top roll 38 by spring 42 and shoulder screw 44 assembly at each end of the roll as best seen in FIG. 3. The lower roll 40 preferably has a harder rubber or synthetic material coating and the upper roll has a softer rubber or synthetic material coating so as to drivingly and sealingly grip the blind panel 46 therebetween. A similar pair 48 of feed rolls 38 and 40 are located at the entrance to the rinse chamber 32 located within the liquid cleaning chamber 30 adjacent to divider wall 26. Likewise, a similar pair 50 of feed rolls are located at the entrance to the drying chamber 34, within the rinse chamber 32 adjacent to divider wall 28, and a pair of feed rolls 51 and 40 are located at the exit end of the drying chamber 34 adjacent to exit end wall 22.

A deflector 52 preferably in the form of a tube with a rectangular cross section is pivotally mounted at 54 to extend from adjacent inlet feed roll pair 24 toward the exit end of the solution cleaning chamber. The deflector 52 is curved gently downwardly and then upwardly in a sinusoidal fashion so that it will guide a blind panel 46 fed through entrance opening 56 in end wall 20 from the feed rollers 38, 40 downwardly into a cleaning solution which is maintained at a level in cleaning chamber 30 between the bottom of entrance opening 56 and the top 58 of the deflector 52 at its lower most point as shown in FIG. 4. The blind panel thus becomes fully immersed in the cleaning solution. A pair of stationary brushes 60 and 62 are located at the exit end of the deflector tube 52 so that the blind panel is guided between the two brushes for through cleaning.

Upper and lower spray nozzle pipes 61 and 63 are located in the rinse chamber 32 to spray a rinsing medium against the upper and lower surfaces of the blind panel as it passes through the rinse chamber. Preferably these pipes are connected together and have a quick disconnect fitting 64 to which a hose can be connected to supply water from an available water tap or alternately from a gravity feed tank should tap water not be available. A wire grill 66 extends from adjacent the opening 68 in divider wall 26 through the rinse chamber 32 and the blind opening 70 in divider wall 28 through the drying chamber 34 to adjacent the pair of exit feed rolls 52 to guide the blind panels through the rinse and drying chambers.

A vacuum drying nozzle 72 extends over the width of the drying chamber 34 as part of a spring loaded self adjusting roller mechanism 74 which maintains the nozzle 72 in close proximity to the top side of wire grill 66 for efficiently suctioning of water from the upper surface of the blind panel passing thereunder. A gear wheel indicated at 75 is positioned in advance of nozzle 72 to engage the top of the blind panel to remove any curvature so the panel is flat as it passes under nozzle 72. A suitable connection 76 is provided to attach a shopvac vacuum hose to the assembly 74. An air jet nozzle pipe 78 extends across the width of the drying chamber 34 below the support grill 66 to supply air to the bottom of the blind panel to dry the lower surface Pressurized air is fed to the nozzle pipe 78 through support pipe 80 from a connection pipe 82 which can be connected to the pressure side of a shop vacuum unit. Additionally or alternatively a squeegee blade 84 can be used to remove water from the lower surface of the fabric. This is shown connected to support pipe 80 but it could be independently supported if an air nozzle 78 is not used.

A sprocket 86 is attached to the upper or top feed roll 38 of each pair 24, 48, 50, and 52 of feed rolls. A chain 88 drives each of the sprockets 86 from drive sprocket 90 driven by motor 92. Motor 92 is preferably a variable speed motor so that the speed of the blind panels 46 passing through the machine can be controlled. A tension sprocket 94 is interposed between the sprockets 86 associated with feed roll pairs 48 and 50. Sprocket 94 can be moved vertically to control the tension in chain 88. A feed table 96 is provided at the entrance end of the machine having adjustable guide members 98 which are adjusted for the width of the blind panel 46.

The overall length of the tank is of the order of five feet with the solution cleaning chamber and the drying chamber each occupying a little over two feet in length and the rinse chamber being somewhat less than one foot long. The overall height of the tank is approximately six inches with the width being between five inches and six inches to allow blinds of all sizes to be accommodated. With this small size and commensurate weight the unit can be carried by one person to service a customer with on site cleaning which diminishes downtime to a minimum as well as reducing the risk of damage and loss in transportation. This also allows the small businessman, whether or not he is involved in an allied cleaning pursuit, to get into the vertical blind cleaning busines with a minimum capital investment and without the fixed expense required for permanent installations. Of course, the equipment can be set up on a permanent basis at a fixed location.

In operation, the tank s placed on a table or bench with the tanks being empty and the drains 36 in each of the chambers being closed. If it has been transported to an on the job cleaning site, we find that the use of a work table on wheels with folding legs and a hide away rack to catch the blinds as they come out of the machine is a desirable accessory since it can be transported with the tank in a standard passenger car. Cleaning fluid is added to the cleaning chamber 30 to a point below entrance opening 56 in end wall 20 and opening 68 in divider wall 26, normally about the mid point of the bottom feed roll 40. The cleaning fluid is a general purpose detergent, or may be a special product designed for the particular fabric or blind material being cleaned.

A hose is connected between the quick disconnect fitting 64 to the spray pipes 61 and 63 in the rinse chamber 32 and to a water tap to supply rinse water. The vacuum side of a shop vacuum is connected to vacuum connector 76 out of the drying chamber 34, and a connection is made to the pressure side of a shop vacuum and air connection 82 out of the drying chamber. The motor 92 is plugged in and turned on, and if it is a variable speed motor, the speed is selected to accomodate the particular material, width, and degree of soil of the blind being cleaned. With the guide members 98 set at the proper width of the blind panel being cleaned, the blinds are fed one at a time off of the feed table 96 through the entrance slot 56 to the point where the feed roller pair 24 at the entrance end of the cleaning chamber begins to feed the blind panel through the guide member 52. The individual blind panels are completely immersed in the cleaning fluid during their travel through the guide 52 so that when they pass through the stationary brushes 60 and 62 both surfaces of the panel will be scrubbed clean prior to entry into the second pair of feed rolls 48 at the entrance end of the rinse chamber. As the blinds leave the feed rolls 48, they are carried on the wire grill 66 to the end of the tank 12. As they pass through the rinse chamber 32, they are rinsed by the water passing through the upper and lower rinse spray pipe 61 and 63. Feed roll pair 50 at the entrance end of the drying chamber or exit end of the rinse chamber continues the transport of the rinsed blinds from the rinse chamber 32 through the drying chamber 34 on the wire grill 66. As the blinds pass under the vacuum drying nozzle 72 the water is removed by the suction from the top surface of the blind panels. As the panels pass by the drying air nozzle and/or the squeegee blade 84, the rinse water is removed from the lower surface of the blind panels. Finally, the blind panels exit from the drying chamber 34 through exit opening 100 in end wall 22 by the action of exit feed roll pair 52.

If the blind panel is a cloth or fabric without a backing, a leader 102 such as that shown in FIG. 7 is used. In this particular design, the blind panel is threaded through slot 104 and its leading edge is put under spring clamp 106. Leaders of other designs can be used, for example, where the retaining member 106 is at the trailing edge of the leader 102 such as the position of slot 104.

The cleaning fluid being used can be drawn off through the drain 36 in the bottom of cleaning chamber 30 when it becomes dirty or at the end of an operation. Likewise the rinse water can be drained from rinse chamber through its drain 36 as required to keep the level below the openings 68 and 70 in compartment walls 26 and 28. Any remaining rinse water would be drained prior to transport at the end of the job. Likewise water can be withdrawn from the drying chamber through its drain 36.

We claim:

1. A vertical blind cleaning machine for cleaning both surfaces of individual blind panels comprising, in combination:

an elongated tank divided into liquid tight solution cleaning, rinse, and drying chambers;

a pair of feed rolls at the entrance end of each of said chambers and at the exit end of said drying chamber for successively and sequentially advancing blind panels through said solution cleaning chamber, rinse chamber and drying chamber;

a deflector in said cleaning chamber directing said panel to be completely immersed in cleaning solution in said solution cleaning chamber;

a pair of brushes in said cleaning chamber for contacting both surfaces of said panel;

spray means in said rinse chamber for spraying a liquid rinse medium against both surfaces of said pane;

liquid removal means in said drying chamber for removing liquid rinse medium from both surfaces of said panel; and, a leader made of a material and to a length to span the distance between adjacent pairs of feed rolls, said leader having means for attachment to the forward end of a blind panel for guiding a fabric blind panel through said cleaning machine.

2. The blind cleaning machine according to claim 1 wherein said liquid removal means includes a vacuum nozzle for drawing liquid away from one of the surfaces of said blind panel.

3. The blind cleaning machine according to claim 2 wherein said vacuum nozzle is mounted on a spring loaded, self adjusting mechanism which keeps the nozzle adjacent one of the surfaces of said blind panel.

4. The blind cleaning machine according to claim 3 wherein said adjusting mechanism holds said vacuum nozzle adjacent the top surface of said blind panel.

5. The blind cleaning machine according to claim 1 wherein said liquid removal system includes a blower nozzle positioned to blow liquid away from the bottom surface of said blind panel.

6. The blind cleaning machine according to claim 1 wherein said liquid removal system includes a squeegee blade contacting the bottom surface of said blind panel.

7. The blind cleaning machine according to claim 1 wherein said deflector means extends from adjacent the pair of feed rolls at the entrance end of said solution cleaning chamber to adjacent said pair of brushes.

8. The blind cleaning machine according to claim 1 wherein each of said pair of feed rolls has a bottom roll which is spring loaded toward an upper roll.

9. The blind cleaning machine according to claim 1 further including adjustable guide means for said blind panels at the entrance end of said solution cleaning chamber.

10. The blind cleaning machine according to claim 1 further including a wire grill extending through said rinse chamber and drying chamber to support said blind panel as it passes therethrough.

11. The blind cleaning machine according to claim 1 wherein each of said pairs of feed rolls are driven by a common drive.

12. The blind cleaning machine according to claim 11 wherein each pair of feed rolls has a bottom roll being biased toward a top roll and each of said top rolls are driven by a common chain drive.

13. The blind cleaning machine according to claim 12 further including a tensioning roll engaging said chain drive between the pair of feed rolls at the entrance end of said rinse chamber and the pair of feed rolls at the entrance end of said drying chamber.

14. The blind cleaning machine according to claim 13 wherein said chain drive is driven by a variable speed motor.

15. The blind cleaning machine according to claim 1 wherein each of said chambers has drain means for removal of liquid therefrom.

* * * * *